US011388934B2

(12) United States Patent
Roup

(10) Patent No.: US 11,388,934 B2
(45) Date of Patent: Jul. 19, 2022

(54) RIGID COLLAR STAND AND GARMENT WITH SAME

(71) Applicant: Talon Technologies, Inc., Woodland Hills, CA (US)

(72) Inventor: Herman Sydney Roup, Santa Barbara, CA (US)

(73) Assignee: Talon Technologies, Inc., Woodland Hills, CA (US)

( * ) Notice: Subject to any disclaimer, the term of this patent is extended or adjusted under 35 U.S.C. 154(b) by 0 days.

(21) Appl. No.: 17/187,842

(22) Filed: Feb. 28, 2021

(65) Prior Publication Data

US 2021/0204616 A1 Jul. 8, 2021

Related U.S. Application Data

(63) Continuation of application No. PCT/IB2019/057370, filed on Sep. 1, 2019.

(60) Provisional application No. 62/726,229, filed on Sep. 1, 2018.

(51) Int. Cl.
*A41B 1/00* (2006.01)
*A41B 1/12* (2006.01)

(52) U.S. Cl.
CPC ..... *A41B 1/12* (2013.01)

(58) Field of Classification Search
CPC .... A41B 1/12; A41B 1/14; A41B 3/06; A41B 3/00
See application file for complete search history.

(56) References Cited

U.S. PATENT DOCUMENTS 1,776,673 A * 9/1930 Tucker ..... A41B 3/04 2/139
2,025,485 A * 12/1935 Tucker ..... A41B 3/02 2/127
4,532,410 A * 7/1985 Wehmeyer ..... A41D 23/00 219/211
4,967,420 A * 11/1990 Johnson ..... A41B 3/00 2/115
9,756,879 B2 * 9/2017 Roup ..... A41B 1/12
(Continued)

FOREIGN PATENT DOCUMENTS

KR 200320617 Y1 7/2003
KR 101354710 B1 1/2014

OTHER PUBLICATIONS

WIPO, International Search Report received in International Application No. PCT/IB2019/057370, dated Jan. 13, 2020, (3p.).
(Continued)

*Primary Examiner* — Richale L Quinn
(74) *Attorney, Agent, or Firm* — Siritzky Law, PLLC

(57) ABSTRACT

A garment includes a collar stand attached to a garment body. The collar stand is formed from an inner piece and an outer piece, and wherein at least one of the inner piece and the outer piece comprises a fabric fused with a rigid fusible substrate. The fabric fused with a rigid fusible substrate has between 0% to 5% stretch, preferably between 0% and 3% stretch, and more preferably between 0% and 2% stretch in at least one direction thereof, and the fabric fused with a rigid fusible substrate has between 0% to 5% shrinkage, preferably between 0% and 3% shrinkage, and more preferably between 0% and 2% shrinkage in said at least one direction thereof.

40 Claims, 6 Drawing Sheets

(56) References Cited

U.S. PATENT DOCUMENTS

| | | | | |
|---|---|---|---|---|
| 2003/0196250 | A1* | 10/2003 | Gadot | A41B 1/02 2/243.1 |
| 2005/0278824 | A1* | 12/2005 | Gadot | A41D 1/02 2/108 |
| 2013/0117902 | A1* | 5/2013 | Aresty | A41B 1/16 2/69 |
| 2013/0318683 | A1* | 12/2013 | Blakely | A41B 7/10 2/124 |
| 2015/0113697 | A1* | 4/2015 | Roup | B29C 53/36 2/69 |
| 2016/0183600 | A1* | 6/2016 | Patterson | A41B 1/10 2/128 |
| 2016/0366949 | A1* | 12/2016 | Roup | A41B 1/16 |
| 2018/0140022 | A1 | 5/2018 | Roup | |
| 2019/0191791 | A1* | 6/2019 | Patterson | A41B 1/16 |
| 2021/0025107 | A1* | 1/2021 | Collins | D06F 71/22 |
| 2021/0100292 | A1* | 4/2021 | Raccuglia | A41D 27/06 |

OTHER PUBLICATIONS

WIPO, International Written Opinion received in International Application No. PCT/IB2019/057370, dated Jan. 13, 2020, (6p.).

* cited by examiner

RIGID COLLAR STAND AND GARMENT WITH SAME

RELATED APPLICATIONS

This application is a continuation of PCT/IB2019/057370, filed Sep. 1, 2019, which claims benefit of U.S. Provisional patent application No. 62/726,229, filed Sep. 1, 2019, the entire contents of both of which are hereby fully incorporated herein by reference for all purposes.

COPYRIGHT STATEMENT

This patent document contains material subject to copyright protection. The copyright owner has no objection to the reproduction of this patent document or any related materials in the files of the United States Patent and Trademark Office, but otherwise reserves all copyrights whatsoever.

FIELD OF THE INVENTION

This invention relates to garments and garment manufacture. More particularly, this invention relates to rigid collar stands and garments with same.

BACKGROUND AND OVERVIEW

Garments, especially men's dress shirts, are typically sized based on collar circumference and sleeve length. Some garments, especially men's dress shirts are generally sized to be worn with the collar closed (e.g., buttoned), and so any shrinkage in the collar will adversely affect the wearer. Unfortunately, the fabrics used for most dress shirts is subject to shrinkage from laundering, and so most dress shirts may become difficult or uncomfortable to wear after multiple washes.

In addition, the fabrics used to form shirt collars may also become stretched out with usage over time, such that the collars may become loose and no longer fit properly.

It is desirable to provide a collar stand that is rigid, as needed, to keep its shape, form, and length. It is further desirable to provide a collar stand with little or no stretch. It is further desirable to provide a collar stand with little or no shrinkage. It is further desirable to provide a garment such as a shirt with such a collar stand.

SUMMARY

The present invention is specified in the claims as well as in the below description. Preferred embodiments are particularly specified in the dependent claims and the description of various embodiments.

Below is a list of garment embodiments. Those will be indicated with a letter "G". Whenever such embodiments are referred to, this will be done by referring to "G" embodiments.

G1. A garment comprising:

a collar stand attached to a garment body, wherein the collar stand is formed from an inner piece and an outer piece, and wherein at least one of the inner piece and the outer piece comprises a fabric fused with a rigid fusible substrate, wherein the fabric fused with a rigid fusible substrate has between 0% to 5% stretch, preferably between 0% and 4% stretch, more preferably between 0% and 3% stretch, still more preferably between 0% and 2% stretch, and most preferably between 0% and 1.5% stretch in at least one direction thereof, and wherein the fabric fused with a rigid fusible substrate has between 0% to 5% shrinkage, preferably between 0% and 4% shrinkage, more preferably between 0% and 3% shrinkage, still more preferably between 0% and 2% shrinkage, and most preferably between 0% and 1.5% shrinkage in at least one direction thereof G2. The garment of embodiment G1, wherein both the inner piece and the outer piece comprise the fabric fused with the rigid fusible substrate.

G3. The garment of embodiment G1, wherein the inner piece comprises a first fabric fused with a first rigid fusible substrate and the outer piece comprises a second fabric fused with a second rigid fusible substrate.

G4. The garment of embodiment G3, wherein the first fabric is the same as the second fabric.

G5. The garment of embodiments G3 or G4, wherein the first rigid fusible substrate is distinct from the second rigid fusible substrate.

G6. The garment of embodiments G3 or G4, wherein the first rigid fusible substrate is the same as the second rigid fusible substrate.

G7. The garment of embodiment G6, wherein the first rigid fusible substrate is oriented in a first direction on the inner piece, and wherein the second rigid fusible substrate is oriented in a second direction on the outer piece, wherein the first direction is distinct from the second direction.

G8. The garment of any one of embodiments G3-G7, wherein the inner piece fused with the first rigid fusible substrate constrains stretch and shrinkage of the collar stand in a first direction, and wherein the outer piece fused with the second rigid fusible substrate constrains stretch and shrinkage of the collar stand in a second direction distinct from the first direction.

G9. The garment of any one of the preceding embodiments, wherein the inner piece has substantially the same shape and size as the outer piece.

G10. The garment of any one of the preceding embodiments, wherein the rigid fusible substrate has substantially no stretch in at least one direction thereof G11. The garment of any one of the preceding embodiments, wherein the rigid fusible substrate has substantially no shrinkage in at least one direction.

G12. The garment of any of any one of the preceding embodiments wherein the collar is substantially rigid.

G13. The garment of any of any one of the preceding embodiments wherein less than the entire collar is substantially rigid.

G14. The garment of any one of the preceding embodiments, wherein the collar stand is attached to a substantially rigid portion of the collar.

G15. The garment of embodiment G14, wherein at least some of the substantially rigid portion of the collar is sewn between the inner piece and the outer piece of the collar stand along a length dimension of the collar stand.

G16. The garment of embodiment G15, wherein the portion of the collar that is sewn between the inner piece and the outer piece has a width (W1) between ⅛" and ¼" (0.3175 cm. to 0.635 cm.) along a length thereof.

G17. The garment of any one of embodiments G14-G16, wherein a portion of the garment body is sewn between the inner piece and the outer piece of the collar stand along a length dimension of the collar stand.

G18. The garment of embodiment G17 wherein the portion of the garment body that is sewn between the inner piece and the outer piece has a width (W2) between ⅛" and ¼" (0.3175 cm. to 0.635 cm.) along a length thereof.

G19. The garment of embodiment G14 wherein at least some of the substantially rigid portion of the collar is sewn between the inner piece and the outer piece of the collar stand along a length dimension of the collar stand, and wherein a portion of the garment body is sewn between the inner piece and the outer piece of the collar stand along a length dimension of the collar stand, and wherein the portion of the collar that is sewn between the inner piece and the outer piece has a width (W1) between ⅛" and ¼" (0.3175 cm. to 0.635 cm.); and wherein the portion of the garment body that is sewn between the inner piece and the outer piece has a width (W2) between ⅛" and ¼" (0.3175 cm. to 0.635 cm.).

G20. The garment of embodiment G19, wherein the collar stand has a width (W), and wherein W1+W2 is between about 5% and 50% of the width (W) of the collar stand.

G21. The garment of embodiment G20, wherein W1+W2 is between about 20% and 40% of the width (W) of the collar stand.

G22. The garment of embodiment G12, wherein at least some of the substantially rigid portion of the collar is sewn between the inner piece and the outer piece of the collar stand along a length dimension of the collar stand, and wherein a portion of the garment body is sewn between the inner piece and the outer piece of the collar stand along a length dimension of the collar stand, and wherein the portion of the collar that is sewn between the inner piece and the outer piece has a width (W1); and wherein the portion of the garment body that is sewn between the inner piece and the outer piece has a width (W2); and wherein the collar stand has a width (W), and wherein W1+W2 is between about 5% and 50% of the width (W) of the collar stand.

G23. The garment of embodiment G22, wherein W1+W2 is between 20% and 40% of the width (W) of the collar stand.

G24. A garment comprising:

a collar stand attached to a garment body, wherein the collar stand is formed from an inner piece and an outer piece, and wherein the inner piece comprises a first fabric fused with a first rigid fusible substrate and the outer piece comprises a second fabric fused with a second rigid fusible substrate, wherein the inner piece has (i) between 0% to 5% stretch, preferably between 0% and 3% stretch, and more preferably between 0% and 2% stretch in a first at least one direction thereof, and (ii) between 0% to 5% shrinkage, preferably between 0% and 3% shrinkage, and more preferably between 0% and 2% shrinkage in the first at least one direction thereof; and wherein the outer piece has (i) between 0% to 5% stretch, preferably between 0% and 3% stretch, and more preferably between 0% and 2% stretch in a second at least one direction thereof, and (ii) between 0% to 5% shrinkage, preferably between 0% and 3% shrinkage, and more preferably between 0% and 2% shrinkage in the second at least one direction thereof G25. The garment of embodiment G24, wherein the first fabric is the same as the second fabric.

G26. The garment of embodiments G24 or G25, wherein the first rigid fusible substrate is distinct from the second rigid fusible substrate.

G27. The garment of embodiments G24 or G25, wherein the first rigid fusible substrate is the same as the second rigid fusible substrate.

G28. The garment of any one of embodiments G24-G27, wherein the first rigid fusible substrate is oriented in a first direction on the inner piece, and wherein the second rigid fusible substrate is oriented in a second direction on the outer piece, wherein the first direction is distinct from the second direction.

G29. The garment of any one of embodiments G24-G28, wherein the first at least one direction is distinct from the second at least one direction.

G30. The garment of any one of embodiments G24-G29, wherein the first at least one direction is a horizontal direction along a length of the collar stand.

G31. The garment of any one of embodiments G24-G30, wherein the second at least one direction is the substantially horizontal direction along a length of the collar stand.

G32. The garment of any one of embodiments G24-G30, wherein the second at least one direction is a substantially vertical direction along a width of the collar stand.

G33. The garment of any one of the preceding embodiments, wherein the garment is a shirt.

The above features along with additional details of the invention are described further in the examples herein, which are intended to further illustrate the invention but are not intended to limit its scope in any way.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE PRESENTLY PREFERRED EXEMPLARY EMBODIMENTS

Although embodiments hereof are described with reference primarily to shirts, those of ordinary skill in the art will appreciate and understand, upon reading this description, that the collar stands described herein apply to all garments that incorporate collar stands, and not just to shirts or dress shirts.

Figure 1:
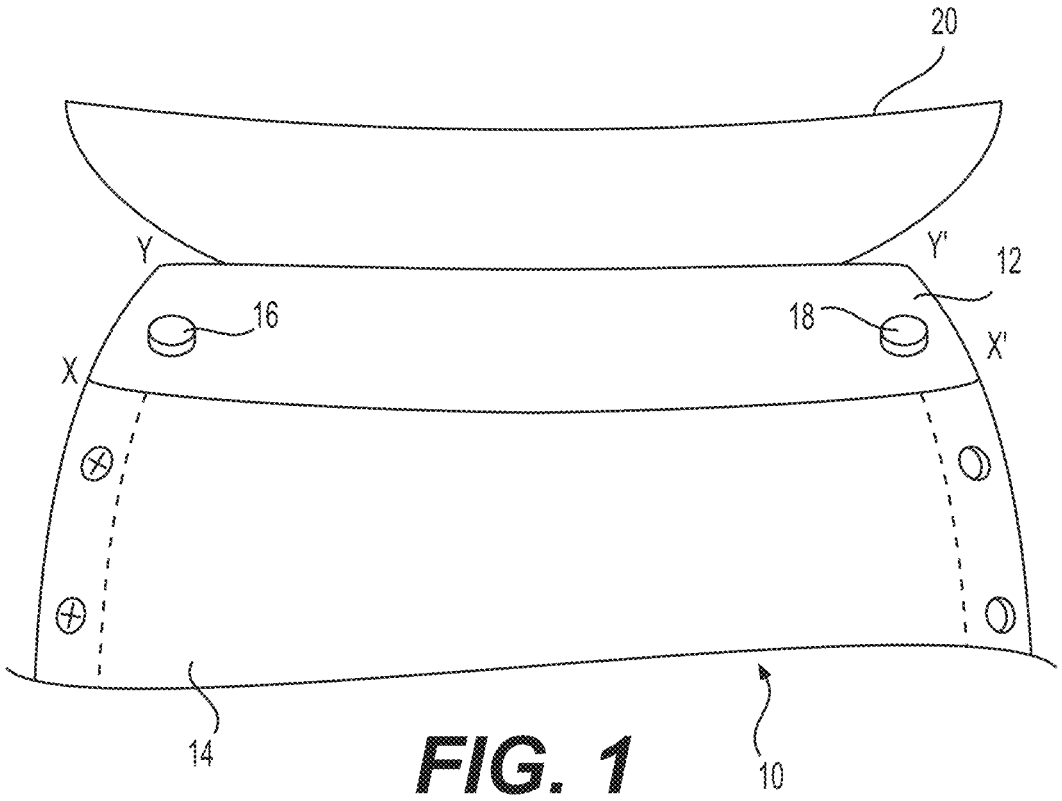
FIG. 1 depicts aspects of a garment collar according to exemplary embodiments hereof.
Figure 2:
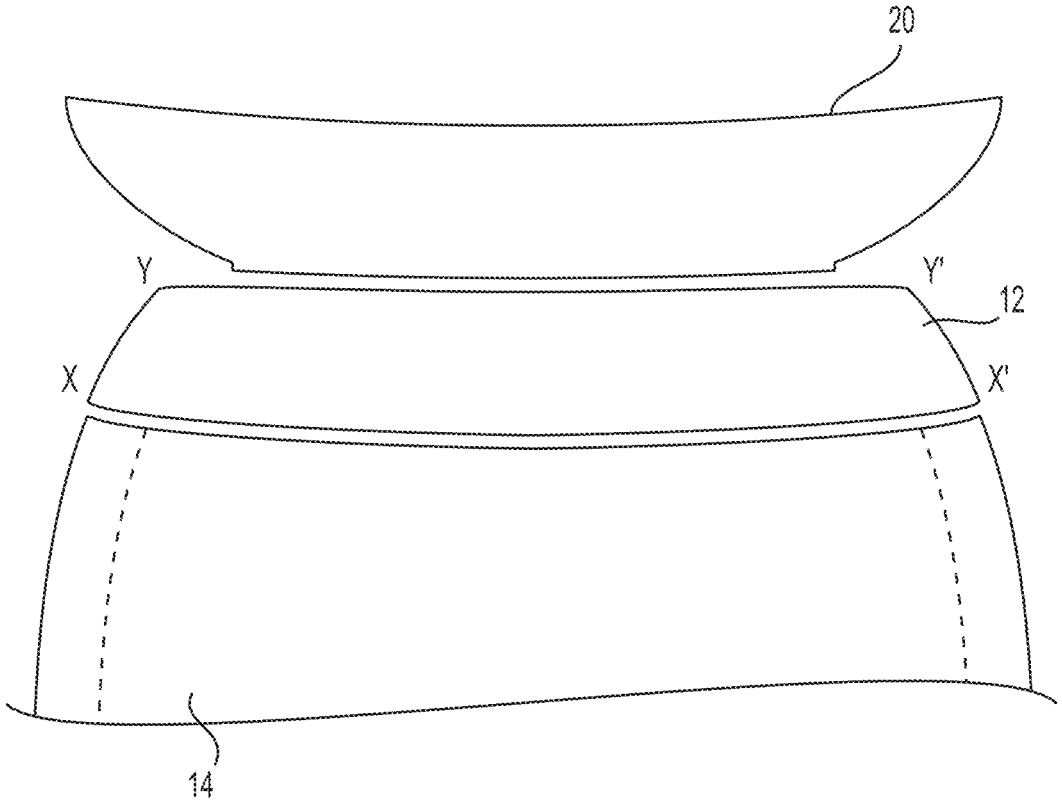
FIG. 2 depicts an exploded view of aspects of the garment collar of FIG. 1.

FIG. 1 shows a garment 10 (e.g., a shirt) incorporating a collar according to exemplary embodiments hereof A collar stand 12 is attached to the garment body 14, e.g., by being sewn along the line X-X'. The collar stand 12 may have a button 16 on one end thereof, and a buttonhole 18 on the other end, and typically defines the garment's neck size. A collar 20 may be attached to the collar stand 12, e.g., by inserting a substantially rigid portion of the collar 20 into the collar stand 12, and sewing along the line Y-Y'. FIG. 2 depicts an exploded view of aspects of the garment, including the collar stand 12, of FIG. 1.

Figure 3:
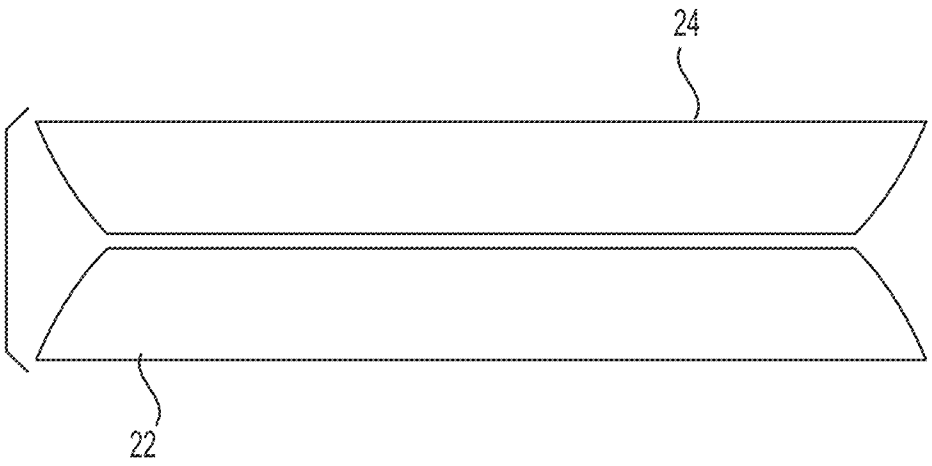
FIG. 3 depicts aspects of a collar stand according to exemplary embodiments hereof.

With reference now to FIG. 3, a collar stand 12 according to exemplary embodiments hereof, may be formed from two substantially matching pieces, an inner piece 22, and an outer piece 24. The inner piece 22 is positioned to be on the inside of the garment 10, when worn, while the outer piece 24 is positioned to be on the outside of the garment 10, when worn. The inner and outer pieces 22, 24, are overlaid to form the collar stand 12. The collar stand 12 preferably curves around the wearer's neck when attached to a garment and worn.

For the purposes of this description, the length of the collar stand 12 is the horizontal dimension in the drawings, and the width of the collar stand is the vertical dimension. A collar stand need not have the same width across its length (i.e., it may be wider at some points than at others). Similarly, a collar stand need not have the same length across its width (i.e., it may be longer at some points than at others). For example, with reference to FIG. 1, the length Y-Y' need not be the same as the length X-X'. As is generally understood, the length of the collar stand 12 is the longer dimension, its width being the shorter dimension.

One of or both the inner and outer pieces 22, 24 of the collar stand 12, may be formed by fusing together a fabric (e.g., a self-fabric) with a rigid fusible substrate.

The inner and outer pieces 22, 24 may be from the same fabric, or they may use different fabrics. When the inner and outer pieces 22, 24 are from the same fabric, the fabric may be differently oriented on each piece.

When both the inner and outer pieces 22, 24 of the collar stand 12 are formed by fusing together a fabric (e.g., a self-fabric) with a rigid fusible substrate, the same or a different rigid fusible substrate may be used with each piece. That is, a first rigid fusible substrate may be used with the inner piece 22, and a second rigid fusible substrate may be used with the outer piece 24 (where the first and second rigid fusible substrates are in some way distinct). For example, the first rigid fusible substrate may provide less stretch and/or shrinkage than the second rigid fusible substrate.

When both the inner and outer pieces 22, 24 of the collar stand 12 are formed by fusing together a fabric (e.g., a self-fabric) with a rigid fusible substrate, the first rigid fusible substrate may be oriented with the inner piece to constrain stretch and/or shrinkage in a first direction (e.g., a substantially horizontal direction of the collar stand), whereas the second rigid fusible substrate may be oriented with the outer piece constrain stretch and/or shrinkage in a second direction distinct from the first direction (e.g., a substantially vertical direction of the collar stand).

In some cases, the first rigid fusible substrate may be the same as the second rigid fusible substrate, oriented differently.

A rigid fusible substrate may be a fusible substrate that may not stretch, or that may not substantially stretch, in a given direction or combination of directions. That is, the rigid fusible substrate may have no stretch properties, such that when a force may be applied to the fusible substrate, or when the substrate may be exposed to heat, cold, moisture, drying, or other conditions, the fusible substrate may not expand or enlarge, and may not increase in dimension. A rigid fusible substrate may also be a fusible substrate that may not shrink, or that may not substantially shrink, in any given direction or combination of directions. That is, the rigid fusible substrate may not have shrinkage properties, such that when a force may be applied to the fusible substrate, or when the substrate may be exposed to heat, cold, moister, drying, or other conditions, the fusible substrate may not shrink, or contract, and may not decrease in dimension.

As used herein, including in the claims, and for the purposes of this description (including the claims), when a material (including, alone or in combination, a fusible substrate, a fabric or any other type of material) is said to have no stretch properties, or is said to not stretch or expand in any given direction, this should be understood to mean that the material may not substantially stretch or expand more than an allowable amount of stretch. In preferred embodiments, the allowable amount of stretch for a material may be no more than 0%-1.5% of the length of the material along the direction of the stretch. In other and less preferred embodiments, the allowable amount of stretch for the material may be no more than 0%-2% of the length of the material along the direction of the stretch. In still other and even less preferred embodiments, the allowable amount of stretch for the material may be no more than 0%-3% of the length of the material along the direction of the stretch. And in yet other even less preferred embodiments, the allowable amount of stretch for the material may be no more than 0%-4% of the length of the material along the direction of the stretch. And in still other even less preferred embodiments, the allowable amount of stretch for the material may be no more than 0%-5% of the length of the material along the direction of the stretch.

Thus, as used herein, the term "substantially no stretch" with respect to a material (including, alone or in combination, a fusible substrate, a fabric, or any other type of material), means that the material has between 0% to 5% stretch, more preferably between 0% and 4% stretch, more preferably between 0% and 3% stretch, still more preferably between 0% and 2% stretch, and most preferably between 0% and 1.5% stretch.

In addition, as used herein, and for the purposes of this description (including the claims), when a when a material (including, alone or in combination, a fusible substrate, a fabric or any other type of material) is said to have no shrinkage properties, or is said to not shrink or contract in any given direction, this is understood to mean that the material may not substantially shrink or contract, and may shrink or contract no more than an allowable amount of shrinkage. In preferred embodiments, the allowable amount of shrinkage for the material (e.g., the rigid fusible substrate or fabric) may be no more than 0%-1.5% of the length of the material along the direction of the shrinkage. In other and less preferred embodiments, the allowable amount of shrinkage for the material (e.g., the rigid fusible substrate or fabric) may be no more than 0%-2% of the length of the material along the direction of the shrinkage. And in still other and even less preferred embodiments, the allowable amount of shrinkage for the material (e.g., the rigid fusible substrate or fabric) may be no more than 0%-3% of the length of the material along the direction of the shrinkage. And in yet other and even less preferred embodiments, the allowable amount of shrinkage for the material may be no more than 0%-4% of the length of the material along the direction of the shrinkage. And in yet other and even less preferred embodiments, the allowable amount of shrinkage for the material may be no more than 0%-5% of the length of the material along the direction of the shrinkage.

Thus, as used herein, the term "substantially no shrinkage" with respect to a material (including, alone or in combination, a fusible substrate, a fabric, or any other type of material), means that the material has between 0% to 5% shrinkage, more preferably between 0% and 4% shrinkage, still more preferably between 0% and 3% shrinkage, even more preferably between 0% and 2% shrinkage, and most preferably between 0% and 1.5% shrinkage.

It is understood by a person of ordinary skill in the art, upon reading this specification, that the amounts of allowable stretch and/or allowable shrinkage described above are exemplary, and that the rigid fusible substrate, fabric, or other material may have any allowable amounts of stretch and/or shrinkage as required by the collar stand 12, the collar 20 and/or the garment 10. It is also understood that the allowable amount of stretch may not be equal to the allowable amount of shrinkage. Thus, e.g., a material may be allowed more stretch than shrinkage, or vice versa.

In exemplary embodiments hereof, the rigid fusible substrate may not substantially stretch or shrink in the horizontal or length direction thereof. In exemplary embodiments hereof, the rigid fusible substrate may not substantially stretch or shrink in the vertical or width direction thereof. In exemplary embodiments hereof, the rigid fusible substrate may not substantially stretch or shrink in any direction that may be at an offset angle with respect to the horizontal or vertical directions. For example, the rigid fusible substrate may not substantially stretch or shrink in a direction that may be at an offset angle of 45 degrees with respect to the horizontal and/or vertical directions. In one example, the rigid fusible substrate may not substantially stretch or shrink in a direction that may be at an offset angle of 30° with respect to the horizontal or vertical directions. It is understood that the offset angles described above are exemplary, and that the rigid fusible substrate may not substantially stretch or shrink in any desired directions and/or offset directions.

In exemplary embodiments hereof, the rigid fusible substrate may not substantially stretch or shrink in any combination of directions simultaneously. For example, the rigid fusible substrate may not substantially stretch or shrink in the horizontal direction or the vertical direction simultaneously. In another example, the rigid fusible substrate may not substantially stretch or shrink in the horizontal direction, the vertical direction or in any direction that may be at an offset angle with respect to the horizontal or vertical directions simultaneously. It is understood that in this case, the allowable amount of stretch and/or shrinkage for the rigid fusible substrate may be different for each different direction, and that the allowable amount of stretch and/or shrinkage for the different directions need not be the same. In preferred embodiments, the allowable amount of stretch and/or shrinkage in the horizontal direction may be less than or equal to the allowable amount of stretch or shrinkage in the vertical direction.

The self fabric used to form the inner and outer pieces 22, 24 may be any general shirting fabric, including cotton, poly-cotton, linen, etc. The self-fabric may, but need not be, the same fabric as the garment.

The self-fabric used to form the pieces 22, 24 may be cut in any way, including, e.g., along its length, breadth, or on a bias.

The self-fabric used to form the pieces 22, 24 may initially be with or without stretch (e.g., a non-compacted woven, a compacted woven, a non-compacted knit or a compacted knit material).

In some embodiments, the pieces of the collar stand (i.e., the inner and outer pieces 22, 24) may be formed by first compacting or otherwise preshrinking the underlying self-fabric to reduce its shrinkage properties, and then combining the compacted or preshrunk underlying self-fabric with the rigid fusible substrate to limit the stretch imposed by the compaction. As should be appreciated, the underlying self-fabric may have the capacity to stretch, and that the stretch may be affected (and, in particular, be limited) by the rigid fusible substrate.

Figure 4:
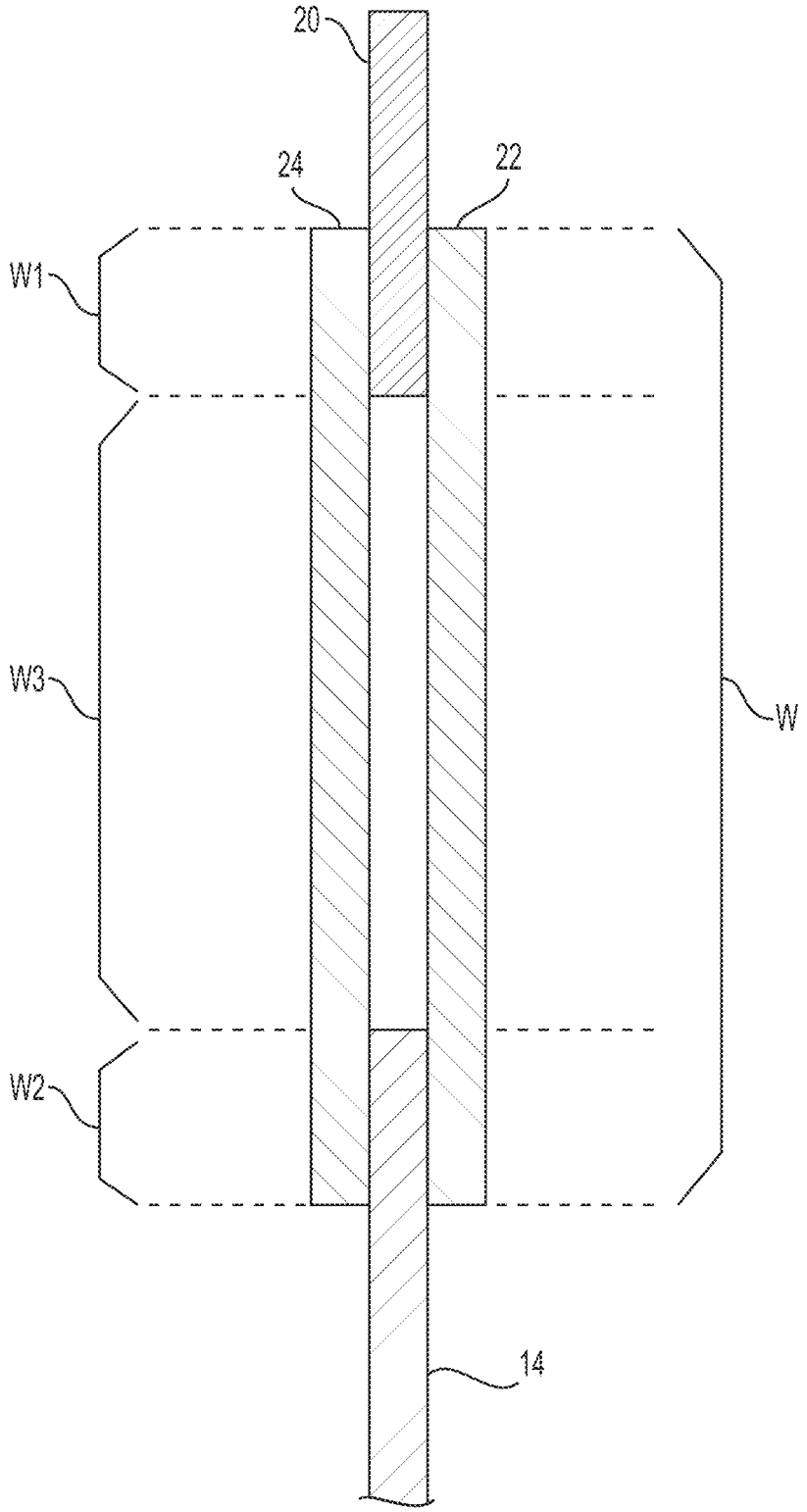
FIG. 4 is a side view of the garment collar attached to a garment using the collar stand according to exemplary embodiments hereof.

FIG. 4 shows a side view of the collar 20 attached to a garment body 14 using the collar stand 24, according to exemplary embodiments hereof.

Figure 6A:
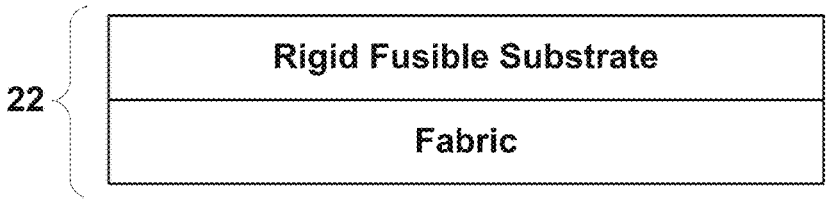
FIGS. 6A-6H depict aspects of collar stands according to exemplary embodiments hereof.
Figure 6B:
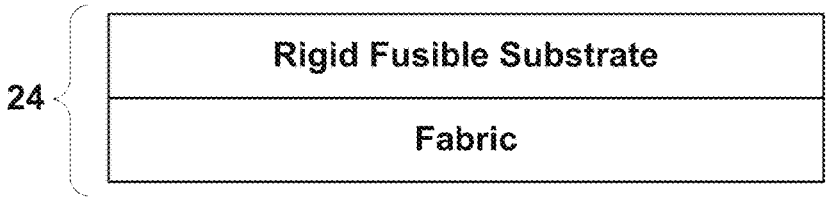
Figure 6C:
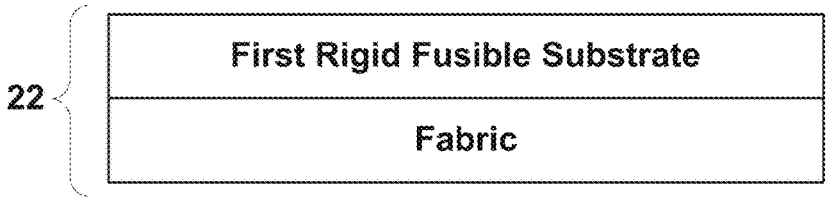
Figure 6D:
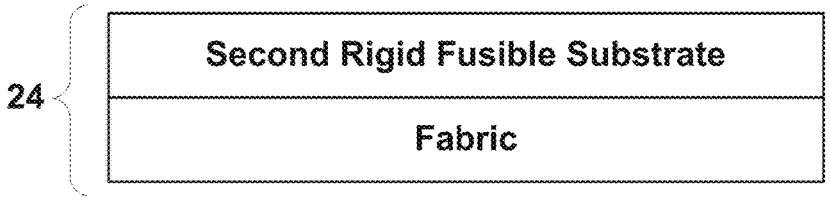
Figure 6E:
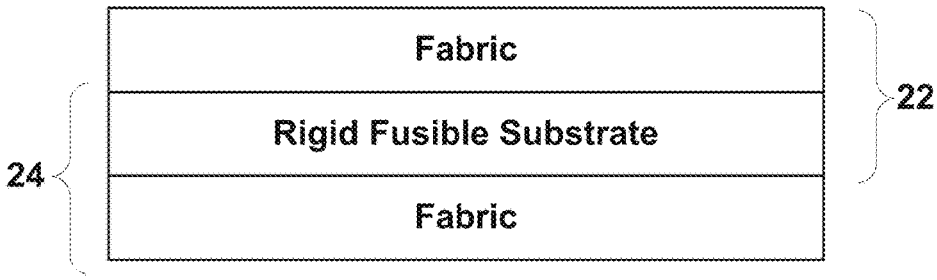
Figure 6F:
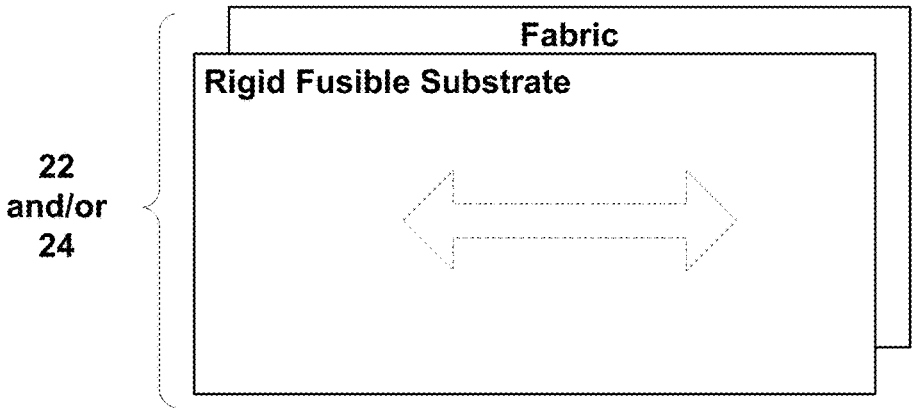
Figure 6G:
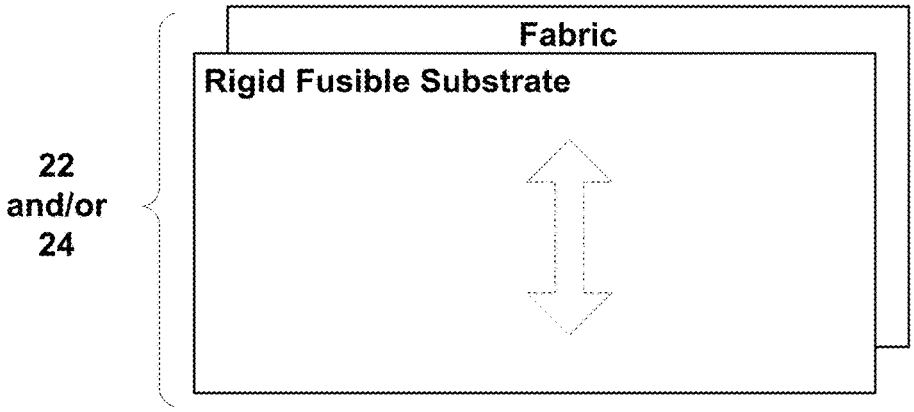
Figure 6H:
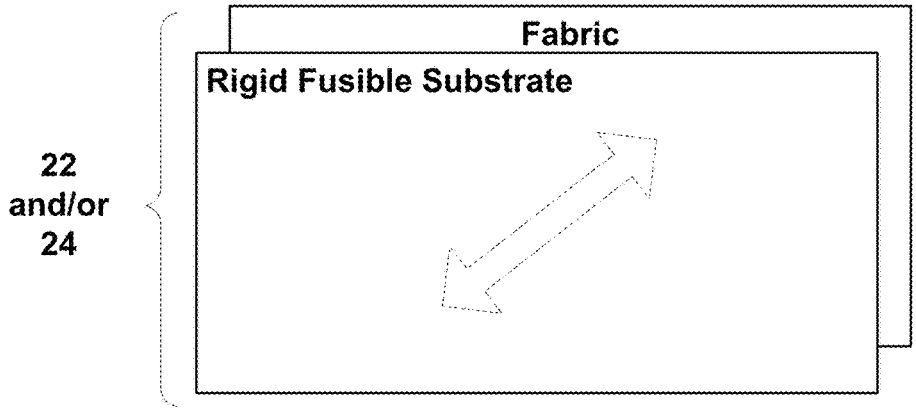

FIGS. 6A-6H depict aspects of collar stands according to exemplary embodiments hereof. FIG. 6A depicts an inner piece 22 comprising a fabric fused with a rigid fusible substrate; FIG. 6B depicts an outer piece 24 comprising a fabric fused with a rigid fusible substrate; FIG. 6C depicts an inner piece 22 comprising a first fabric fused with a first rigid fusible substrate; FIG. 6D depicts an outer piece 24 comprising a second fabric fused with a second rigid fusible substrate; FIG. 6E depicts inner and outer pieces (22, 24) in which the right fusible substrate is the same; FIG. 6F is a top view of an inner and/or outer piece (22, 24) in which a rigid fusible substrate controls shrinkage in a horizontal direction. FIG. 6G is a top view of an inner and/or outer piece (22, 24) in which a rigid fusible substrate controls shrinkage in a vertical direction. FIG. 6H is a top view of an inner and/or outer piece (22, 24) in which a rigid fusible substrate controls shrinkage in a horizontal direction. In the drawings in FIGS. 6F-6H, the fabric is shown for descriptive purposes, although the fusible substrate may cover the entire fabric.

As noted above, the bottom of the collar stand 12 may be attached to the garment body 14, e.g., along the line X-X' (FIGS. 1-2). If the garment has a collar (and not just a collar stand), the top of the collar stand 12 may attached to the collar 20, e.g., by being sewn along the line Y-Y' (FIGS. 1-2).

With reference to FIGS. 2 and 4, to connect the collar 20 to the collar stand 12, a lower portion of the collar 20 is positioned between the inner and outer pieces 22, 24 of the collar stand 12 and the pieces are connected (e.g., stitched together). The lower portion that is positioned as described is preferably substantially rigid. The width (W1) of the lower portion of the collar 20 that is positioned between the inner and outer pieces 22, 24 of the collar stand 12 is preferably about ⅛" to ¼" (0.3175 cm. to 0.635 cm.).

Preferably, the collar stand 12 has no stretch and/or shrinkage properties (i.e., substantially no stretch and/or shrinkage) in a substantially horizontal direction, substantially parallel to the bottom of the collar stand 12, thereby to the top of the garment 10. The collar stand 12 also preferably has no stretch and/or shrinkage properties (i.e., substantially no stretch and/or shrinkage) in a substantially vertical direction, substantially vertical to the bottom of the collar stand 12, thereby to the top of the garment 10.

To attach the collar stand 12 to the garment body 14, a top portion of the garment body 14 may be positioned between the inner and outer pieces 22, 24 of the collar stand 12 and the pieces may be stitched together. The width (W2) of the garment portion of the collar 20 that is positioned between the inner and outer pieces of the collar stand 12 is preferably about ⅛" to ¼" (0.3175 cm. to 0.635 cm.).

It should be appreciated that the width W1 should be sufficient to maintain the collar 20 in the collar stand 12 without taking up too much space in the collar stand 12. Similarly, the width W2 should be sufficient to maintain the collar stand 12 connected to the garment body 14, also without taking up too much space in the collar stand 12.

Figure 5:
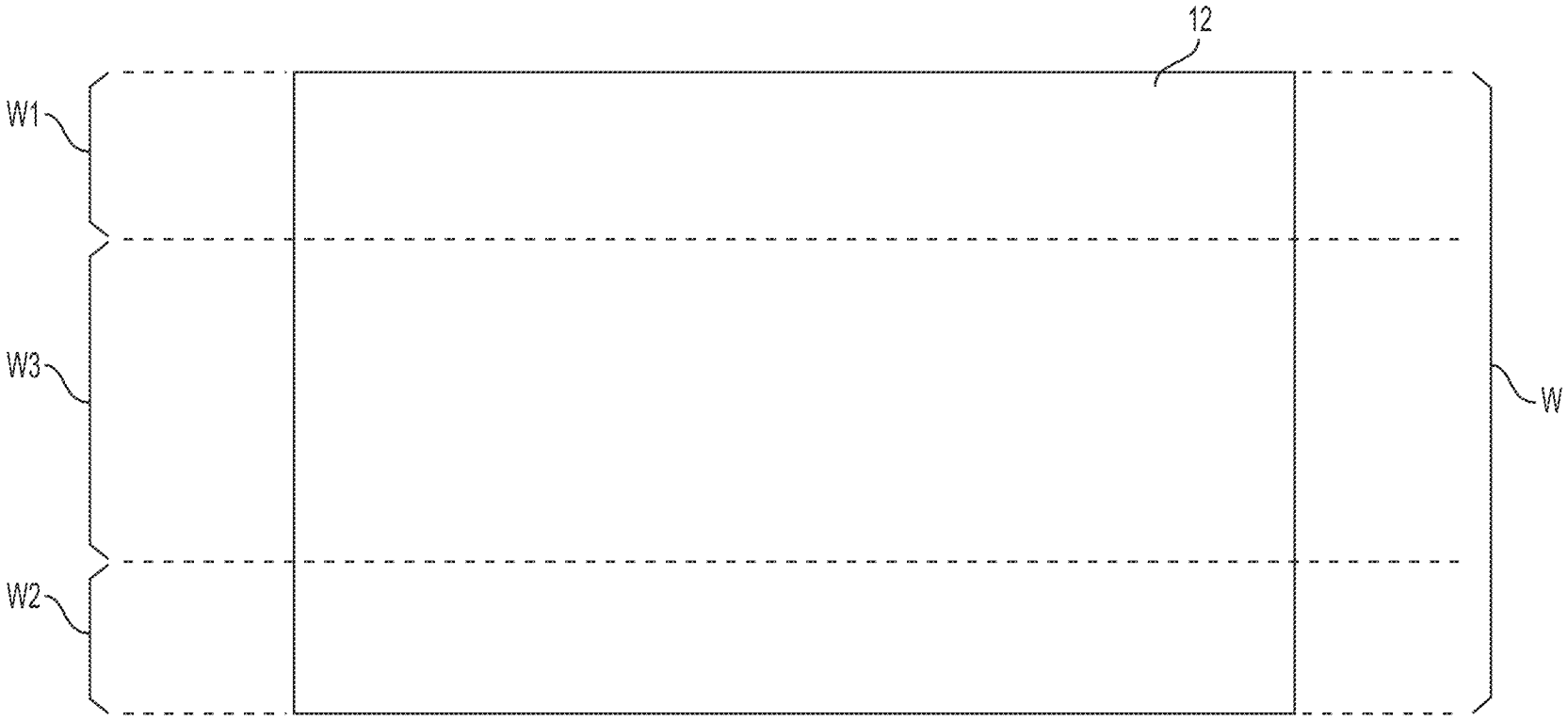
FIG. 5 depicts aspects of a garment collar attached to a garment using the collar stand according to exemplary embodiments hereof.

With reference to FIG. 5, the width W3 of the portion of the collar stand 12 that does not cover either a portion of the collar 20 or a portion of the garment 14 is preferably at least 80% of the total width of the collar stand 12, at least for a substantial length of the collar stand 12. In some preferred embodiments hereof the width W3 averages between 50% and 95% of the total width (W) of the collar stand 12. In other words, the sum of the widths W1 and W2 averages between 5% and 50% of the total width (W) of the collar stand 12. That is, preferably W1+W2 is between 5% and 50% of W along the length of the collar stand 12. For example, an exemplary collar stand 12 has a total width of about 1¼ inches (3.175 cm.) (W), the width (W1) of the lower portion of the collar is about ¼ inch (0.635 cm), and the width (W2) of the garment portion is also about ¼ inch (0.635 cm). In this example, the width (W3) is about ¾" (1.905 cm) or 60% of the total width (W) of the collar stand.

As noted, the inner and outer pieces 22, 24 of the collar stand 12 are not necessarily parallel, and so the widths W1 and W2, and the width W3 may not be the same across the entire collar stand 12.

As noted, in preferred embodiments hereof, the collar 20, or at least the lower portion of the collar 20 that is attached to the collar stand 12, is substantially rigid. In some preferred embodiments, e.g., for dress shirts and the like, the entire collar 20 is substantially rigid.

The combined collar 20 and collar stand 12 described herein provides numerous advantages over prior approaches. Since the collar stand 12 may be compacted and/or pre-shrunk, it will not shrink as much as a non-compacted collar stand 12. In this way, the collar stand 12 may retain its original dimensions (in particular, its original length) and may not become tight and uncomfortable to wear over time and multiple washings.

In addition, the collar stand 12 may not expand due to it comprising a rigid fusible substrate. This may prevent the collar stand 12 from becoming stretched out with usage over time, thereby retaining its desired fit and form.

As described above, the collar stand 12 is connected to the garment body 14. As understood by those of ordinary skill in the art, the collar stand 12 is connected to different parts of the garment body 14. In the back of the garment, the collar stand 12 is typically connected to the garment's yoke or to a back panel of the garment.

Thus is described a garment collar stand 12 that does not expand or stretch or shrink or that has substantially no stretching or shrinkage. The collar stand may not shrink during washing and/or drying, and may not expand during usage (e.g., when forces may be applied to it). The described collar stand 12 may have no shrinkage, and as such, will not shrink and become uncomfortable to wear. The described collar stand 12 may also have no stretch, and as such, will not stretch and become loose and misfitting when worn.

EXAMPLES

Example 1

A collar stand is formed from an inner piece and an outer piece. The inner piece is formed from a fabric fused with a rigid fusible substrate. The inner piece has substantially no stretch (between 0% and 5% stretch) and substantially no shrinkage (between 0% and 5% shrinkage) in at least one direction thereof. The collar stand is attached to a garment, e.g., as described above.

Example 1.1

Same collar stand as in Example 1, attached to a garment, where the stretch of the inner piece is between 0% and 4% in at least one direction thereof.

Example 1.2

Same collar stand as in any of the previous Examples, attached to a garment, where the stretch of the inner piece is between 0% and 3% in at least one direction thereof.

Example 1.3

Same collar stand as in any of the previous Examples, attached to a garment, where the stretch of the inner piece is between 0% and 2% in at least one direction thereof.

Example 1.4

Same collar stand as in any of the previous Examples, attached to a garment, where the stretch of the inner piece is between 0% and 1.5% in at least one direction thereof.

Example 1.5

Same collar stand as in any of the previous Examples, attached to a garment, where the shrinkage of the inner piece is between 0% and 4% in at least one direction thereof.

Example 1.6

Same collar stand as in any of the previous Examples, attached to a garment, where the shrinkage of the inner piece is between 0% and 3% in at least one direction thereof.

Example 1.7

Same collar stand as in any of the previous Examples, attached to a garment, where the shrinkage of the inner piece is between 0% and 2% in at least one direction thereof.

Example 1.8

Same collar stand as in any of the previous Examples, attached to a garment, where the shrinkage of the inner piece is between 0% and 1.5% in at least one direction thereof.

Example 2

Same collar stand of previous Examples, wherein outer piece is formed with a fabric fused with a rigid fusible substrate. The outer piece has substantially no stretch (between 0% and 5% stretch) and substantially no shrinkage (between 0% and 5% shrinkage) in at least one direction thereof. The collar stand is attached to a garment, e.g., as described above.

Example 2.1

Same collar stand as in any of the previous Examples, attached to a garment, where the stretch of the outer piece is between 0% and 4% in at least one direction thereof.

Example 2.2

Same collar stand as in any of the previous Examples, attached to a garment, where the stretch of the outer piece is between 0% and 3% in at least one direction thereof.

Example 2.3

Same collar stand as in any of the previous Examples, attached to a garment, where the stretch of the outer piece is between 0% and 2% in at least one direction thereof.

Example 2.4

Same collar stand as in any of the previous Examples, attached to a garment, where the stretch of the outer piece is between 0% and 1.5% in at least one direction thereof.

Example 2.5

Same collar stand as in any of the previous Examples, attached to a garment, where the shrinkage of the outer piece is between 0% and 4% in at least one direction thereof.

Example 2.6

Same collar stand as in any of the previous Examples, attached to a garment, where the shrinkage of the outer piece is between 0% and 3% in at least one direction thereof.

Example 2.7

Same collar stand as in any of the previous Examples, attached to a garment, where the shrinkage of the outer piece is between 0% and 2% in at least one direction thereof.

Example 2.8

Same collar stand as in any of the previous Examples, attached to a garment, where the shrinkage of the outer piece is between 0% and 1.5%.

Example 3

Same collar stand of previous Examples, wherein the collar stand has substantially no stretch (between 0% and 5% stretch) and substantially no shrinkage (between 0% and 5% shrinkage) in at least one direction thereof. The collar stand is attached to a garment, e.g., as described above.

Example 3.1

Same collar stand as in any of the previous Examples, attached to a garment, where the stretch of the collar stand is between 0% and 4% in at least one direction thereof.

Example 3.2

Same collar stand as in any of the previous Examples, attached to a garment, where the stretch of the collar stand is between 0% and 3% in at least one direction thereof.

Example 3.3

Same collar stand as in any of the previous Examples, attached to a garment, where the stretch of the collar stand is between 0% and 2% in at least one direction thereof.

Example 3.4

Same collar stand as in any of the previous Examples, attached to a garment, where the stretch of the collar stand is between 0% and 1.5% in at least one direction thereof.

Example 3.5

Same collar stand as in any of the previous Examples, attached to a garment, where the shrinkage of the collar stand is between 0% and 4% in at least one direction thereof.

Example 3.6

Same collar stand as in any of the previous Examples, attached to a garment, where the shrinkage of the collar stand is between 0% and 3% in at least one direction thereof.

Example 3.7

Same collar stand as in any of the previous Examples, attached to a garment, where the shrinkage of the collar stand is between 0% and 2% in at least one direction thereof.

Example 3.8

Same collar stand as in any of the previous Examples, attached to a garment, where the shrinkage of the collar stand is between 0% and 1.5% in at least one direction thereof.

Example 4

Same collar stand as in any of the previous Examples, attached to a garment, wherein the inner and outer pieces use different fabric and/or different rigid fusible substrates.

Example 5

Same collar stand as in in previous Examples, attached to a garment, where the garment is a shirt.

CONCLUSION

As used in this description, the term "portion" means some or all. So, for example, "A portion of P" may include some of "P" or all of "P". In the context of a conversation, the term "portion" means some or all of the conversation.

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used herein, including in the claims, the phrase "using" means "using at least," and is not exclusive. Thus, e.g., the phrase "using Z" means "using at least Z." Unless specifically stated by use of the word "only", the phrase "using Z" does not mean "using only Z."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means "X is at least partially distinct from Y," and does not mean "X is fully distinct from Y." Thus, as used herein, including in the claims, the phrase "X is distinct from Y" means that X differs from Y in at least some way.

It should be appreciated that the words "first" and "second" in the description and claims are used to distinguish or identify, and not to show a serial or numerical limitation. Similarly, the use of letter or numerical labels (such as "(a)", "(b)", and the like) are used to help distinguish and/or identify, and not to show any serial or numerical limitation or ordering.

As used herein, when a range is specified as "between about X to Y" for some values of X and Y, this means "between about X to about Y," and includes X and Y.

The mere fact that certain measures are recited in mutually different dependent claims does not indicate that a combination of these measures cannot be used to fulfill aspects of the present invention.

The present technology is also understood to encompass the exact terms, features, numerical values or ranges etc., if in here a relative term, such as "about", "substantially", "ca.", "generally", "at least", "at the most" or "approximately" is used in this specification, such a term should also be construed to also include the exact term. That is, e.g., "substantially straight" should be construed to also include "(exactly) straight." In other words, "about 3" shall also cover exactly 3, or "substantially perpendicular" shall also comprise "perpendicular."

Use of exemplary language, such as "for instance," "such as," "for example," "e.g.," and the like, is merely intended to better illustrate the invention and does not indicate a limitation on the scope of the invention unless so claimed.

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent, or similar purpose can replace features disclosed in the specification, unless stated otherwise. Thus, unless stated otherwise, each feature disclosed represents one example of a generic series of equivalent or similar features.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

What is claimed:

1. A garment comprising:

a collar stand attached to a garment body, wherein said collar stand is formed from an inner piece and an outer piece, and wherein at least one of the inner piece and the outer piece comprises a fabric fused with a rigid fusible substrate, wherein the fabric comprises a compacted and/or pre-shrunk self-fabric, and wherein the fabric fused with a rigid fusible substrate has between 0% and 2% shrinkage in at least one direction thereof, wherein the inner piece comprises a first fabric fused with a first rigid fusible substrate, and the outer piece comprises a second fabric fused with a second rigid fusible substrate.

2. The garment of claim 1 wherein both the inner piece and the outer piece comprise the fabric fused with the rigid fusible substrate.

3. The garment of claim 1, wherein the first fabric is the same as the second fabric.

4. The garment of claim 1, wherein the first rigid fusible substrate is distinct from the second rigid fusible substrate.

5. The garment of claim 1, wherein the first rigid fusible substrate is the same as the second rigid fusible substrate.

6. The garment of claim 5, wherein the first rigid fusible substrate is oriented in a first direction on the inner piece, and wherein the second rigid fusible substrate is oriented in a second direction on the outer piece, wherein the first direction is distinct from the second direction.

7. The garment of claim 1, wherein the inner piece fused with the first rigid fusible substrate constrains shrinkage of the collar stand in a first direction, and wherein the outer piece fused with the second rigid fusible substrate constrains shrinkage of the collar stand in a second direction distinct from the first direction.

8. The garment of claim 1, wherein the inner piece has substantially the same shape and size as the outer piece.

9. The garment of claim 1, wherein the rigid fusible substrate has substantially no shrinkage in at least one direction.

10. The garment of claim 1, wherein the collar is substantially rigid.

11. The garment of claim 1, wherein less than the entire collar is substantially rigid.

12. The garment of claim 1, wherein the collar stand is attached to a substantially rigid portion of said collar.

13. The garment of claim 12, wherein at least some of said substantially rigid portion of said collar is sewn between said inner piece and said outer piece of said collar stand along a length dimension of said collar stand.

14. The garment of claim 13, wherein said portion of said collar that is sewn between said inner piece and said outer piece has a width W1 between 0.3175 cm. and 0.635 cm. along a length thereof.

15. The garment of claim 12, wherein a portion of said garment body is sewn between said inner piece and said outer piece of said collar stand along a length dimension of said collar stand.

16. The garment of claim 15 wherein said portion of said garment body that is sewn between said inner piece and said outer piece has a width W2 between 0.3175 cm. and 0.635 cm. along a length thereof.

17. The garment of claim 12 wherein at least some of said substantially rigid portion of said collar is sewn between said inner piece and said outer piece of said collar stand along a length dimension of said collar stand, and wherein a portion of said garment body is sewn between said inner piece and said outer piece of said collar stand along a length dimension of said collar stand, and wherein said portion of said collar that is sewn between said inner piece and said outer piece has a width W1 between 0.3175 cm. and 0.635 cm.; and wherein said portion of said garment body that is sewn between said inner piece and said outer piece has a width W2 between 0.3175 cm. and 0.635 cm.

18. The garment of claim 17, wherein said collar stand has a width W, and wherein W1+W2 is between about 5% and 50% of the width W of the collar stand.

19. The garment of claim 18, wherein W1+W2 is between about 20% and 40% of the width W of the collar stand.

20. The garment of claim 12, wherein at least some of said substantially rigid portion of said collar is sewn between said inner piece and said outer piece of said collar stand along a length dimension of said collar stand, and wherein a portion of said garment body is sewn between said inner piece and said outer piece of said collar stand along a length dimension of said collar stand, and wherein said portion of said collar that is sewn between said inner piece and said outer piece has a width W1; and wherein said portion of said garment body that is sewn between said inner piece and said outer piece has a width W2; and wherein said collar stand has a width W, and wherein W1+W2 is between about 5% and 50% of the width W of the collar stand.

21. The garment of claim 20, wherein W1+W2 is between 20% and 40% of the width W of the collar stand.

22. The garment of claim 1, wherein the self-fabric comprises a non-compacted woven, or a compacted woven, or a non-compacted knit or a compacted knit material.

23. The garment of claim 1, wherein the fabric was formed by compacting or pre shrinking the self-fabric.

24. The garment of claim 1, wherein the fabric fused with a rigid fusible substrate has between 0% and 1.5% shrinkage in said at least one direction thereof.

25. A garment comprising:

a collar stand attached to a garment body, wherein said collar stand is formed from an inner piece and an outer piece, and wherein the inner piece comprises a first fabric fused with a first rigid fusible substrate and the outer piece comprises a second fabric fused with a second rigid fusible substrate, wherein the first fabric comprises a first compacted and/or preshrunk self-fabric, and wherein the second fabric comprises a second compacted and/or preshrunk self-fabric, and wherein the inner piece has between 0% and 3% shrinkage in a first at least one direction thereof; and wherein the outer piece has between 0% and 3% shrinkage in a second at least one direction thereof.

26. The garment of claim 25, wherein the first fabric is the same as the second fabric.

27. The garment of claim 25, wherein the first rigid fusible substrate is distinct from the second rigid fusible substrate.

28. The garment of claim 25, wherein the first rigid fusible substrate is the same as the second rigid fusible substrate.

29. The garment of claim 25, wherein the first rigid fusible substrate is oriented in a first direction on the inner piece, and wherein the second rigid fusible substrate is oriented in a second direction on the outer piece, wherein the first direction is distinct from the second direction.

30. The garment of claim 25, wherein the first at least one direction is distinct from the second at least one direction.

31. The garment of claim 25, wherein the first at least one direction is a horizontal direction along a length of the collar stand.

32. The garment of claim 25, wherein the second at least one direction is a horizontal direction along a length of the collar stand.

33. The garment of claim 25, wherein the second at least one direction is a substantially vertical direction along a width of the collar stand.

34. The garment of claim 25, wherein the garment is a shirt.

35. The garment of claim 25, wherein the first compacted and/or preshrunk self-fabric comprises:

a non-compacted woven, or a compacted woven, or a non-compacted knit or a compacted knit material, and wherein the second compacted and/or preshrunk self-fabric comprises a non-compacted woven, or a compacted woven, or a non-compacted knit or a compacted knit material.

36. The garment of claim 25, wherein the first fabric was formed by compacting or preshrinking the self-fabric.

37. The garment of claim 25, wherein the inner piece has between 0% and 2% shrinkage in said first at least one direction thereof.

38. The garment of claim 25, wherein the inner piece has between 0% and 1.5% shrinkage in said first at least one direction thereof.

39. The garment of claim 25, wherein the outer piece has between 0% and 2% shrinkage in said second at least one direction thereof.

40. The garment of claim 25, wherein the outer piece has between 0% and 1.5% shrinkage in said second at least one direction thereof.

* * * * *